US006904879B2

(12) United States Patent
Kato

(10) Patent No.: US 6,904,879 B2
(45) Date of Patent: Jun. 14, 2005

(54) LUBRICATION SYSTEM FOR TWO-CYCLE ENGINE

(75) Inventor: Masahiko Kato, Hamamatsu (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/626,216

(22) Filed: Jul. 23, 2003

(65) Prior Publication Data

US 2004/0129237 A1 Jul. 8, 2004

(30) Foreign Application Priority Data

Jul. 23, 2002 (JP) ..... 2002-214474

(51) Int. Cl.[7] ..... F02B 33/04
(52) U.S. Cl. ..... 123/73 AD
(58) Field of Search ..... 123/73 AD, 196 R, 123/198 C; 184/6.28, 6.5, 7.4; 417/416, 32, 34, 417

(56) References Cited

U.S. PATENT DOCUMENTS 5,597,051 A * 1/1997 Moriya et al. ..... 184/6.1
5,921,758 A * 7/1999 Anamoto et al. ..... 417/416
5,934,242 A * 8/1999 Anamoto ..... 123/196 R

FOREIGN PATENT DOCUMENTS

JP 10-37730 2/1998

OTHER PUBLICATIONS

Co–pending U.S. Patent Application "Lubrication System for Two–Cycle Engine" U.S. Appl. No. 10/439,049, filed May 15, 2003, Inventor Masahiko Kato.

* cited by examiner

*Primary Examiner*—Henry C. Yuen
*Assistant Examiner*—Hyder Ali
(74) *Attorney, Agent, or Firm*—Knobbe, Martens, Olson & Bear, LLP

(57) ABSTRACT

An engine has a lubrication system configured to lubricate at least a portion of the engine with lubricant. The lubrication system has a lubrication pump that periodically pressurizes the lubricant toward the portion of the engine. A first sensor senses an engine speed. A second sensor senses an engine load. A third sensor senses a temperature of the lubricant or the engine. A control device controls the lubrication pump. The control device determines a frequency of periodic pressurization by the lubrication pump based upon outputs from the first and second sensors. The control device determines a pressurization time of the lubrication pump based upon at least one of outputs from the first, second and third sensors.

28 Claims, 8 Drawing Sheets

LUBRICATION SYSTEM FOR TWO-CYCLE ENGINE

PRIORITY INFORMATION

This application is based on and claims priority under 35 U.S.C. §119 to Japanese Patent Application No. 2002-214474, filed on Jul. 23, 2002, the entire contents of which is hereby expressly incorporated by reference herein.

BACKGROUND OF THE INVENTION

1. Field of the Invention

The present application relates to a lubrication system for a two-cycle engine and, more particularly, to a lubrication system that incorporates a lubrication pump that pressurizes and delivers lubricant to a portion of a two-cycle engine.

2. Description of Related Art

In all fields of engine design, there is an increasing emphasis on obtaining more effective emission control. Recent two-cycle engines, therefore, incorporate a lubricant pump to deliver a desired amount of lubricant to lubricate internal portions of the engines. Mechanically operated pumps can be used as the lubricant pump. Such mechanical pumps, however, are not easily controlled to provide highly precise amounts of lubricant in response to engine operations. Electrically operable pumps tend to replace the mechanical pumps because higher precision controls are more widely available with such electrical pumps.

The electrical pumps can periodically pressurize lubricant under the control of a control device, such as, for example, an electronic control unit (ECU). The ECU can control a frequency of the periodic pressurization with, for example, an electronic control signal configured to operate the pump in accordance with a desired duty cycle. The higher the frequency, the greater the amount of the lubricant.

An electromagnetic solenoid pump is one type of such electrical pump. Japanese Laid Open Patent Publication 10-37730 discloses a lubrication system incorporating such an electromagnetic solenoid pump. The solenoid pump has a pumping piston reciprocally disposed in a pump housing. A plunger is coupled with the pumping piston. An electromagnetic solenoid can actuate the plunger. A control device controls the solenoid to selectively actuate or release the plunger such that the pumping piston periodically pressurizes the lubricant.

The control device disclosed in Japanese Laid Open Patent Publication 10-37730 has a control map that provides an amount of lubricant required by the engine versus an engine speed and determines a frequency of energization of the solenoid using the control map. The solenoid pump thus can pressurize a proper amount of lubricant in response to the engine speed of the engine.

SUMMARY OF THE INVENTION

One aspect of at least one of the inventions disclosed herein includes the realization that where a solenoid is operated under a duty cycle to provide lubricant to an engine based on engine speed, the amount of lubricant delivered can be inadequate under certain operating conditions. For example, when the engine speed is constant, engine load can still vary. For instance, if the engine powers a land vehicle, the engine load can increase when the vehicle ascends a slope, i.e., goes up a hill). Also, if the engine powers a watercraft, the engine load can increase when the watercraft proceeds against wind. Under such circumstances, the engine requires a more appropriate amount of lubricant.

In accordance with another aspect of at least one of the inventions disclosed herein, an internal combustion engine comprises a lubrication system arranged to lubricate at least a portion of the engine with lubricant. The lubrication system has a lubrication pump that pressurizes the lubricant toward the portion of the engine. A first sensor is configured to sense an engine speed of the engine. A second sensor is configured to sense an engine load of the engine. A control device is configured to control the lubrication pump. The control device determines an amount of lubricant that is pressurized by the lubrication pump based upon outputs from the first and second sensors to control the lubrication pump.

In accordance with another aspect of at least one of the inventions disclosed herein, an internal combustion engine comprises a lubrication system arranged to lubricate at least a portion of the engine with lubricant. The lubrication system has a lubrication pump that periodically pressurizes the lubricant toward the portion of the engine. A first sensor is configured to sense an engine speed of the engine. A second sensor is configured to sense an engine load of the engine. A control device is configured to control the lubrication pump. The control device determines a frequency of periodic pressurization by the lubrication pump based upon outputs from the first and second sensors to control the lubrication pump.

In accordance with a further aspect of at least one of the inventions disclosed herein, an internal combustion engine comprises a lubrication system arranged to lubricate at least a portion of the engine with lubricant. The lubrication system has a lubrication pump that periodically pressurizes the lubricant toward the portion of the engine. A first sensor is configured to sense an engine speed of the engine. A second sensor is configured to sense an engine load of the engine. A control device is configured to control the lubrication pump. The control device determines a pressurization time of the lubrication pump based upon at least one of outputs from the first and second sensors to control the lubrication pump.

In accordance with a further aspect of at least one of the inventions disclosed herein, an internal combustion engine comprises a lubrication system arranged to lubricate at least a portion of the engine with lubricant. The lubrication system has a lubrication pump that periodically pressurizes the lubricant toward the portion of the engine. A first sensor is configured to sense an engine speed of the engine. A second sensor is configured to sense an engine load of the engine. A third sensor is configured to sense a temperature of the lubricant or the engine. A control device is configured to control the lubrication pump. The control device determines a pressurization time of the lubrication pump based upon at least one of outputs from first, second and third sensors.

In accordance with a further aspect of at least one of the inventions disclosed herein, an internal combustion engine comprises a lubrication system arranged to lubricate at least a portion of the engine with lubricant. The lubrication system has a lubrication pump that periodically pressurizes the lubricant toward the portion of the engine. A first sensor is configured to sense an engine speed of the engine. A second sensor is configured to sense an engine load of the engine. A third sensor is configured to sense a temperature of the lubricant or the engine. A control device is configured to control the lubrication pump. The control device determines a frequency of periodic pressurization by the lubrication pump based upon outputs from the first and second sensors. The control device determines a pressurization time of the lubrication pump based upon at least one of the outputs from the first and second sensors and an output from the third sensor.

In accordance with a further aspect of at least one of the inventions disclosed herein, a control method is provided for a lubrication system that lubricates at least a portion of an engine. The method comprises sensing an engine speed of the engine, sensing an engine load of the engine, determining an amount of lubricant that is pressurized by a lubrication pump based upon the sensed engine speed and the sensed engine load, aid actuating the lubrication pump to pressurize the determined amount of lubricant.

In accordance with a further aspect of at least one of the inventions disclosed herein, a control method is provided for a lubrication system that lubricates at least a portion of an engine. The lubrication system has a lubrication pump periodically pressurizes lubricant. The method comprises sensing an engine speed of the engine, sensing an engine load of the engine, determining a frequency of periodic pressurization by the lubrication pump based upon the sensed engine speed and the sensed engine load, and actuating the lubrication pump to pressurize the lubricant with the determined frequency.

In accordance with a further aspect of at least one of the inventions disclosed herein, a control method is provided for a lubrication system that lubricates at least a portion of an engine. The lubrication system has a lubrication pump periodically pressurizes lubricant. The method comprises sensing an engine speed of the engine, sensing an engine load of the engine, determining a pressurization time of the lubrication pump based upon at least the sensed engine speed or the sensed engine load, and actuating the lubrication pump to pressurize the lubricant with the determined pressurization time.

In accordance with a further aspect of at least one of the inventions disclosed herein, a control method is provided for a lubrication system that lubricates at least a portion of an engine. The lubrication system has a lubrication pump periodically pressurizes lubricant. The method comprises sensing an engine speed of the engine, sensing an engine load of the engine, sensing a temperature of the lubricant or the engine, determining a pressurization time of the lubrication pump based upon at least the sensed engine speed, the sensed engine load or the sensed temperature of the lubricant or the engine, and actuating the lubrication pump to pressurize the lubricant with the determined pressurization time.

In accordance with a further aspect of at least one of the inventions disclosed herein, a control method is provided for a lubrication system that lubricates at least a portion of an engine. The lubrication system has a lubrication pump periodically pressurizes lubricant. The method comprises sensing an engine speed of the engine, sensing an engine load of the engine, sensing a temperature of the lubricant or the engine, determining a frequency of periodic pressurization by the lubrication pump based upon the sensed engine speed and the sensed engine load, determining a pressurization time of the lubrication pump based upon at least the sensed engine speed, the sensed engine load or the sensed temperature of the lubricant or the engine, and actuating the lubrication pump to pressurize the lubricant with the determined frequency and the determined pressurization time.

BRIEF DESCRIPTION OF THE DRAWINGS

These and other features, aspects and advantages of the inventions disclosed herein are described below with reference to the drawings of a preferred embodiment, which is intended to illustrate and not to limit the inventions. The drawings comprise eight figures in which.

DETAILED DESCRIPTION OF THE PREFERRED EMBODIMENT

The present lubrication system described below has particular utility in the context of a two-cycle engine for an outboard motor, and thus, is described in the context of such an outboard motor. The lubrication system, however, can be used with other types of two-cycle engines employed by any machines whatsoever using engine power such as, for example, watercrafts (e.g., personal watercrafts), land vehicles (e.g., motorcycles) and utility machines (e.g., lawn mowers).

Figure 1:
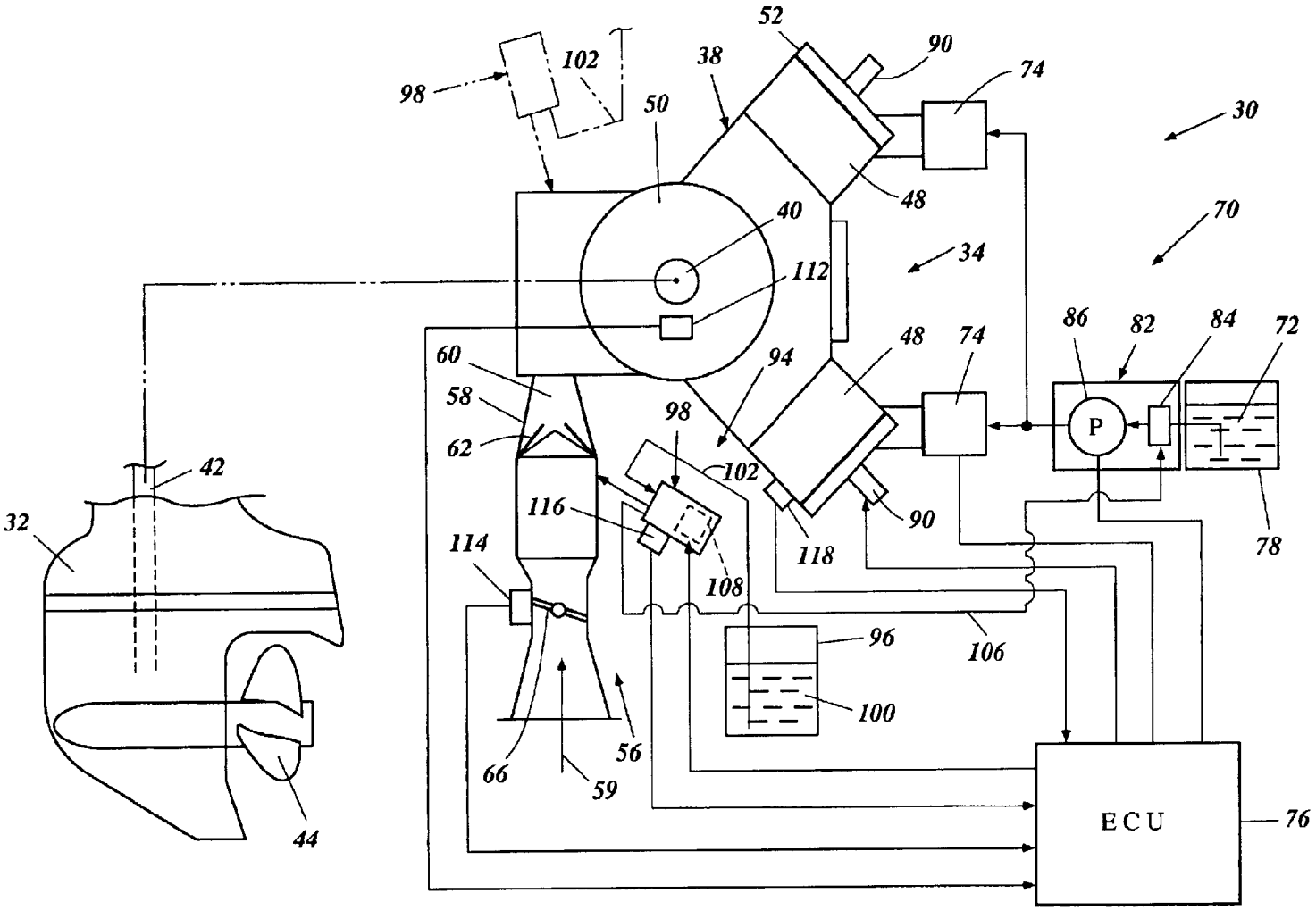
FIG. 1 illustrates a schematic diagram of portions of an outboard motor that has an engine incorporating a lubrication system that is configured in accordance with preferred embodiments of the at least one of the inventions disclosed herein, wherein an upper part of the outboard motor is broken away, and the engine and an air intake system for the engine are shown in a top plan view.

With reference to FIG. 1, an outboard motor 30 has a bracket assembly comprising a swivel bracket and a clamping bracket which are typically associated with a housing unit 32. The outboard motor 30 can be mounted on an associated watercraft by the bracket assembly. The outboard motor 30 includes a power head that is positioned above the housing unit 32. The power head comprises a protective cowling assembly and an internal combustion engine 34. An engine support is unitarily or separately formed atop the housing unit 32 and forms a tray together with the cowling assembly. The tray holds a bottom of the engine 34 and the engine 34 is affixed to the engine support.

The engine 34 comprises an engine body 38 and a crankshaft 40 that is rotatably journaled relative to the engine body 38. The crankshaft 40 rotates about a generally vertically extending axis. This facilitates the connection of the crankshaft 40 to a driveshaft 42 which depends into the housing unit 32.

A propulsion device is mounted on a lower portion of the housing unit 32 and the driveshaft 42 drives the propulsion device. The illustrated propulsion device is a propeller 44. The driveshaft 42 drives the propeller 44 through a transmission (not shown). The transmission includes a changeover mechanism that can change a rotational direction of the propeller 44 among forward, neutral and reverse.

The engine 34 operates on a two-cycle, crankcase compression principle. The illustrated engine 34 is generally configured in a V-shape, with a pair of cylinder bank 48 extending generally rearwardly. Each bank 48 defines one or more cylinder bores. In the illustrated embodiment, each bank 48 defines three cylinder bores. The cylinder bores extend generally horizontally and are vertically spaced apart from each other in the bank 48. As used in this description, the term "horizontally" means that the subject portions, members or components extend generally in parallel to the water line where the associated watercraft is resting when the outboard motor 30 is not tilted. The term "vertically" in turn means that portions, members or components extend generally normal to those that extend horizontally when the associated watercraft is resting when the outboard motor 30 is not tilted. Although the inventions are described in conjunction with the engine 34, the inventions disclosed herein can be utilized with an engine having other cylinder numbers and other cylinder configurations.

The crankshaft 40 is journaled for rotation within a crankcase chamber defined in part by a crankcase member 50 that is affixed to the cylinder banks 48. Pistons are reciprocally disposed within the cylinder bores. The pistons are coupled with the crankshaft 40 through connecting rods. The crankshaft 40 thus rotates with the reciprocal movement of the pistons.

Cylinder head assemblies 52 are affixed to each cylinder bank 48 to close open ends of the respective cylinder bores. Each cylinder head assembly 52 defines a plurality of recesses on its inner surface corresponding to the cylinder bores. Each of these recesses defines a combustion chamber together with the cylinder bore and the piston.

The engine 34 preferably is provided with an air intake system 56 that guides air to each section of the crankcase chamber associated with each cylinder bore. The air finally is supplied to the combustion chambers through a route described below. The intake system 56 comprises a plurality of air intake conduits 58. The air is drawn into the respective intake conduits 58 through an air inlet device as indicated by the arrow 59. The air intake device preferably defines a plenum chamber. Each air intake conduit 58 defines an air intake passage 60 connecting the plenum chamber and each section of the crankcase chamber associated with each combustion chamber. The air drawn into the plenum chamber thus is delivered to the sections of the crankcase chamber through the intake conduits 58.

Each intake conduit 58 preferably incorporates a reed valve 62 configured to allow air to flow into the section of the crankcase chamber and to prevent the air in the section of the crankcase chamber from flowing back to the plenum chamber. Each intake conduit 58 also incorporates a throttle valve 66 between the plenum chamber and the reed valve 62. Each throttle valve 66 preferably is a butterfly type and is pivotally journaled on each intake conduit 58 to regulate an amount of air flowing therethrough. The operator can change the pivotal position, i.e., a throttle valve position or throttle valve open degree, through a suitable control mechanism (not shown).

The air drawn into the respective sections of the crankcase chamber is preliminarily compressed by the pistons, during their movement toward the crankshaft 40. The air, then, moves into the combustion chambers through a scavenge system. The scavenge system preferably is formed as a Schnurle-type system that comprises a pair of main scavenge passages connected to each cylinder bore and positioned on diametrically opposite sides. These main scavenge passages terminate in main scavenge ports so as to direct scavenge air flows into the combustion chamber.

In addition, an auxiliary scavenging passage is formed between the main scavenge passages and terminates in an auxiliary scavenging port which also provides a scavenge air flow. Thus, at the scavenge stroke, the air in the crankcase chamber is transferred to the combustion chambers to be further compressed by the pistons during their movement toward the cylinder head assemblies 52. The scavenge ports are selectively opened and closed as the piston reciprocates.

The engine 34 preferably is provided with a fuel supply system 70 that supplies fuel 72 to the combustion chambers. The illustrated fuel supply system 70 is configured to operate under a direct fuel injection principle in which the fuel is directly sprayed into the combustion chambers. The fuel supply system 70 comprises fuel injectors 74 allotted to the respective combustion chambers. The fuel injectors 74 preferably are mounted on the cylinder head assemblies 52.

A control device controls the fuel injectors 74 to inject fuel. In the illustrated embodiment, the control device preferably is an electronic control unit (ECU) 76. The ECU 76 preferably controls an injection timing and a duration of each injection. The ECU 76 comprises at least a central processing unit (CPU) and at least one storage or memory device. The ECU 76 preferably controls engine related components other than the fuel injectors 74, which will be described shortly. The storage devices store control programs and reference maps for controlling the components including the fuel injectors 74. The CPU preferably conducts the control programs to control the engine related components in referring to the maps based upon output signals from sensors.

The fuel supply system 70 additionally comprises a fuel supply tank 78 that contains the fuel 72. The fuel supply tank 78 preferably is placed in the hull of the watercraft. A fuel delivery unit 82 is provided between the fuel supply tank 78 and the fuel injectors 74 and particularly on the outboard motor 30 to deliver the fuel 72 to the fuel injectors 74. The fuel delivery unit 82 preferably comprises a vapor separator tank 84 and a plurality of fuel pumps 86, although FIG. 1 schematically illustrates the fuel delivery unit 82. The vapor separator tank 84 temporarily contains the fuel 72 and also can separate vapor from the fuel 72 to prevent vapor lock from occurring in the fuel supply system 70.

The fuel pumps 86 preferably include low pressure fuel pumps and high pressure fuel pumps to develop an extremely high pressure step by step. At least one of the fuel pumps operates under control of the ECU 76. The fuel delivery unit 82 also comprises high pressure regulators to regulate the developed high pressure at a fixed or constant pressure level. Excessive fuel preferably returns back to the vapor separator 84.

With continued reference to FIG. 1, the engine 34 preferably is provided with an ignition or firing system. Spark plugs 90 are affixed to the cylinder head assemblies 52 so as to expose an electrode thereof into the combustion chambers. The spark plugs 90 ignite air/fuel charges in the combustion chambers under control of the ECU 76.

The engine 34 preferably is provided with an exhaust system (not shown) that guides burned charges, i.e., exhaust gases, to an external location from the combustion chambers. The exhaust system has one or more exhaust ports that are formed in the cylinder banks 48 to communicate with each combustion chamber. The exhaust ports are selectively opened or closed with the reciprocal movement of each piston. The exhaust system can discharge the exhaust gases to the body of water, which surrounds the outboard motor 30, through a hub of the propeller 44 above idle operation. At idle, the exhaust gasses can be discharged to the atmosphere through an above-water outlet.

Each fuel injector 74 sprays fuel directly into the associated combustion chamber. The sprayed fuel is mixed with the air delivered through the scavenge passages to an air/fuel charge. The injection timing and the duration of the fuel injection and the firing timing are under control of the ECU 76. The spark plug 90 fires the air/fuel charge. Once the air/fuel charge burns in each combustion chamber, each piston is moved by the pressure produced in the combustion chamber. At this time, exhaust ports are uncovered. The burnt charge or exhaust gases thus are discharged through the exhaust system.

Figure 2:
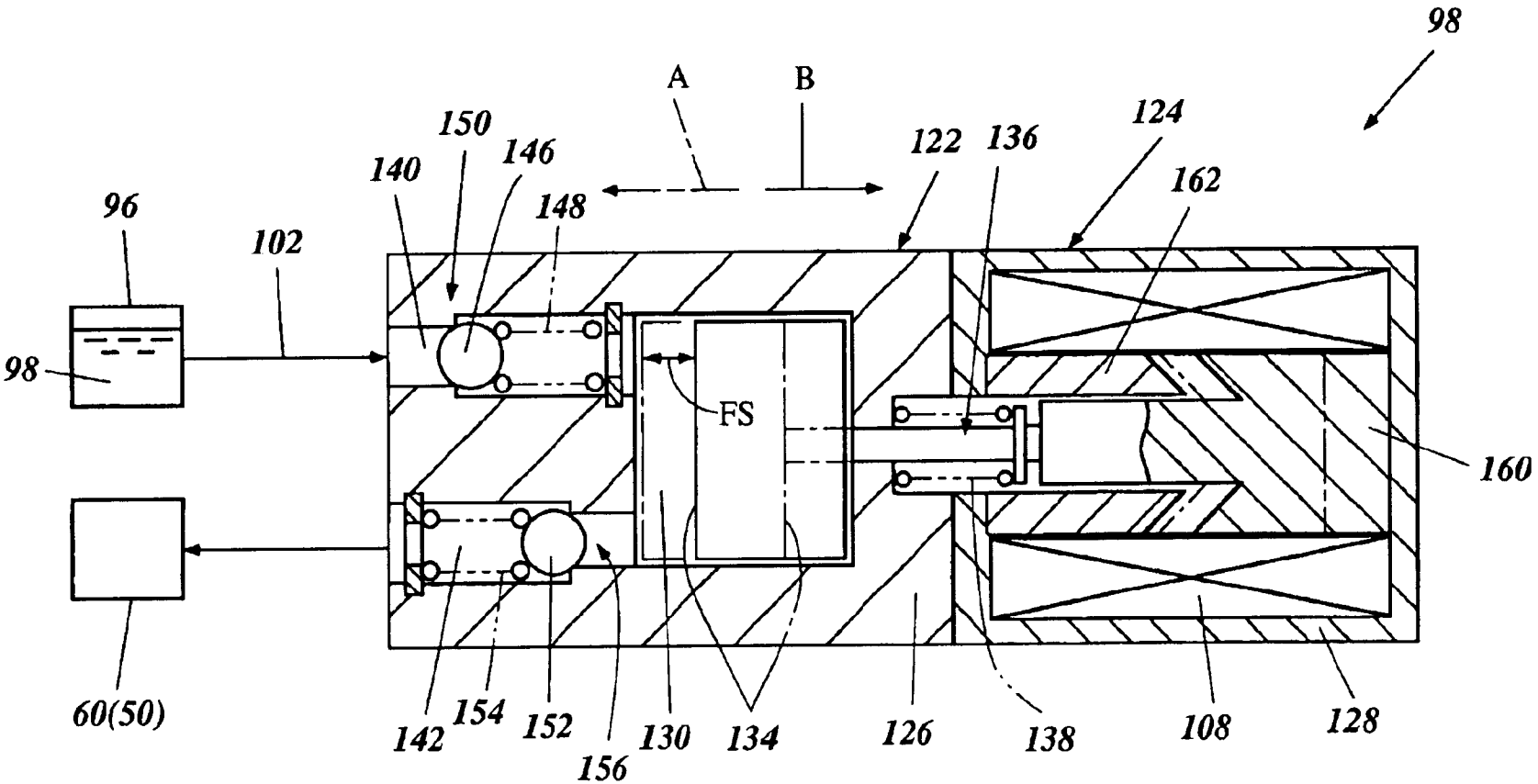
FIG. 2 illustrates a schematic view of a lubrication pump applied in the lubrication system of FIG. 1.

With reference to FIGS. 1 and 2, the engine 34 is provided with the foregoing lubrication system, which is identified generally by the reference numeral 94. The lubrication system 94 preferably comprises a lubricant tank 96 and a lubrication pump 98. The lubricant tank 96 contains lubricant oil 100. A lubricant supply passage 102 couples the lubrication tank 96 with the lubrication pump 98. Preferably but not necessarily, the lubricant tank 96 is mounted on the engine body 38.

An auxiliary lubricant tank (not shown), which preferably has a larger capacity than the lubricant tank 96, preferably is placed in the watercraft to store a sufficient amount of the lubricant 100 to provide a desired range of operation of the associated watercraft. Preferably, the auxiliary lubricant tank is connected to the lubricant tank 96 through a proper lubricant passage and a pump pressurizes the lubricant in the auxiliary lubricant tank to the lubricant tank 96.

Preferably, the lubrication pump 98 periodically pressurizes lubricant toward portions of the engine 34 that benefit from lubrication. In the illustrated arrangement, the lubrication pump 98 has one inlet port and six outlet ports. The inlet port is connected to the lubricant tank 96 through the lubricant supply passage 102. The outlet ports preferably are connected to the respective intake passages 60 upstream of the reed valves 62 to inject the lubricant 100 into the intake passages 60. The lubricant is drawn into the crankcase chamber together with the air and is delivered to the engine portions such as, for example, connecting portions of the connecting rods with the pistons and also with the crankshaft 40.

In one variation, the outlet ports can be positioned downstream of the reed valves 62. In another variation, the outlet ports can be connected directly to the crankcase chamber within the crankcase member 50 as indicated by the phantom line of FIG. 1.

In the illustrated arrangement, some forms of direct lubrication can be additionally employed for delivering lubricant directly to certain engine portions. For example, an extra outlet port can be formed on the lubrication pump 98 to deliver part of the lubricant 100 to the vapor separator tank 84 through a lubricant delivery passage 106. Alternatively, the lubricant delivery passage 106 can be branched off from the lubricant supply passage 102, one branch passage directed to the lubrication pump 98 and another branch passage directed to the vapor separator tank 84. In this alternative, a lubricant delivery pump is additionally necessary in the lubricant delivery passage 106 to pressurize the part of the lubricant 100 to the vapor separator tank 84.

The lubrication pump 98 preferably comprises an electromagnetic solenoid actuator 108 that is controlled by the ECU 76. The lubrication pump 98 and the solenoid actuator 108 are described in greater detail below with reference to FIG. 2.

The outboard motor 30 can have other systems, devices and components which are not described above. For instance, a water cooling system can be provided to cool the engine 34 and the exhaust system with the water. The cooling system can be an open-loop type that takes water into the system from the body of water and discharges the water thereto after the water has traveled around water jackets in the engine body 38 and portions of the exhaust system.

With reference to FIG. 1, as described above, the ECU 76 controls at least the fuel injectors 74, the spark plugs 90, one of the fuel pumps 86 and the lubrication pump 98. In order to control these components, the outboard motor 30 is provided with a number of sensors that sense either engine running conditions, ambient conditions or conditions of the outboard motor 30 that can affect engine performance.

There is provided a crankshaft angle position sensor 112 that senses a crankshaft angle position and outputs a crankshaft angle position signal to the ECU 76. The ECU 76 can calculate an engine speed N (r.p.m.) using the crankshaft angle position signal versus time. In this regard, the crankshaft angle position sensor 112 and part of the ECU 76 form an engine speed sensor. The crankshaft angle position sensor 112, or another sensor, can also be used to provide reference position data to the ECU 76 for timing purposes, such as for the timing of fuel injection and/or ignition timing.

Operator's demand or engine load, as indicated by an angular position Th? of the throttle valve 66, is sensed by a throttle valve position sensor 196 which outputs a throttle valve position or load signal to the ECU 76. Alternatively or additionally, an intake pressure sensor can be provided downstream of the throttle valve 66 in the intake passage 60 to sense the intake pressure that can also represent the engine load. The intake pressure sensed by the intake pressure sensor is negative pressure unless the reed valve 62 closes. Further, an air amount sensor such as, for example, an air flow meter can alternatively or additionally be provided to sense an amount of the air in the intake passage 60 that can also represent the engine load.

A lubricant temperature sensor 116 is provided at the lubrication pump 98 to sense a temperature $T_L$ of the lubricant 100 that is injected to the intake passages 60 and outputs a lubricant temperature signal to the ECU 76. In one variation, the lubricant temperature sensor 116 can be positioned at the lubricant tank 96.

An engine temperature sensor 118 is provided at a portion of the engine body 38 to sense a temperature $T_E$ of the engine body 38 and outputs an engine temperature signal to the ECU 76. In one variation, the engine temperature sensor 118 can sense a temperature of the cooling water in the water jackets instead of directly sensing the temperature of the engine body 38.

Preferably, other than those sensors described above, a number of sensors can be provided. For example, a lubricant level sensor can be placed at the lubricant tank 96 to sense a lubricant level in the lubricant tank 96 and outputs a lubricant level signal to the ECU 76 such that the ECU 76 can control the lubricant delivery pump to pressurize the lubricant in the auxiliary lubricant tank to the lubricant tank 96 when the lubricant level is lower than a preset level.

With reference to FIG. 2, a structure and an operation of the lubrication pump 98 is described below. It should be noted that the actual lubrication pump 98 has at least six outlet ports connected to the respective intake passages 60 of the intake conduits 58 as described above, although FIG. 2 schematically illustrates only one outlet port. If necessary, an extra outlet port is added to deliver the lubricant 100 to the fuel supply system 70.

The lubrication pump 98 preferably comprises a pump unit 122 and a solenoid unit 124. The pump unit 122 has a pump housing 126, while the solenoid unit 124 has a solenoid housing 128. Both housings 126, 128 are coupled with each other by fastening members such as, for example, screws. In one variation, the housings 126, 128 can be unitarily formed as a single housing.

The pump housing 126 defines a cavity 130 in which a piston 134 is reciprocally disposed. The piston 134 occupies a certain volume of the cavity 130 and a distal end of the piston 134 can move in a full stroke range or distance FS. The full stroke range FS substantially determines a full displacement of the lubrication pump 98. In other words, the maximum amount of the lubricant injected every stroke of the piston 134 is determined depending on the full stroke range FS.

The pump housing 126 defines an opening communicating with an inside of the solenoid housing 128. A piston rod 136 extends from the piston 134 through the opening and enters the inside of the solenoid housing 128 beyond a distal end of the pump housing 126. The opening is widened toward the inside of the solenoid housing 128 to form a step. The piston rod 136 has a retainer at a portion in close proximity to its end. A coil spring 138 is placed between the step and the retainer to bias the piston rod 136 toward the solenoid unit 124. Thus, the piston 134 normally is biased toward an initial position as indicated by the solid line of FIG. 2.

The cavity 130 also communicates outside through an inlet port 140 and outlet ports 142 generally located on a side opposite to the solenoid unit 124. In the illustrated arrangement, the inlet port 140 is connected to the lubricant tank 96 through the lubricant supply passage 102 and the outlet ports 142 are connected to the respective intake passages 60 as described above.

The inlet port 140 is narrowed toward the outside from a mid portion of the inlet port 140 to form a step. A ball valve 146 is positioned at the step so as to be movable toward the cavity 130. A coil spring 148 is placed between the ball 146 and a retainer disposed at an inner surface of the inlet port 140 to bias the ball 146 onto the step. The inlet port 140 is closed when the ball 146 is seated at the step. Thus, the ball 146 normally is seated at the step. The ball 146 and the spring 148 together form a check valve 150 that allows the lubricant 100 to flow into the cavity 130 and prevents the lubricant 100 from flowing out of the cavity 130 through the inlet port 140.

Similarly, each outlet port 142 is narrowed toward the cavity 130 from a mid portion of the outlet port 142 to form a step. A ball valve 152 is positioned at the step so as to be movable toward the outside. A coil spring 154 is placed between the ball 152 and a retainer formed at an inner surface of the outlet port 142 to bias the ball 152 onto the step. The outlet port 142 is closed when the ball 152 is seated at the step. The ball 152 normally is seated at the step. The ball 152 and the spring 154 together form a check valve 156 that allows the lubricant to flow outside and prevents the lubricant from flowing back to the cavity 130 from the outlet port 142.

The solenoid unit 124 incorporates the electromagnetic solenoid actuator 108, a plunger 160 and a stopper 162 in the solenoid housing 128. The solenoid 108 surrounds the plunger 160 so as to allow the plunger 160 to move axially therein. An end of the plunger 160 abuts the piston rod 136 and pushes the piston rod 136 toward the check valves 150, 156 when the plunger 160 is actuated. The stopper 162 limits a stroke of the plunger 160. The stroke limit of the plunger 160 preferably is equal to or slightly larger than the stroke limit of the piston 134. The piston 134 thus moves fully in the full stroke range FS when the plunger 160 moves to the stopper 162. The fully extended position of the piston 134 is indicated by the phantom line of FIG. 2.

Figure 3:
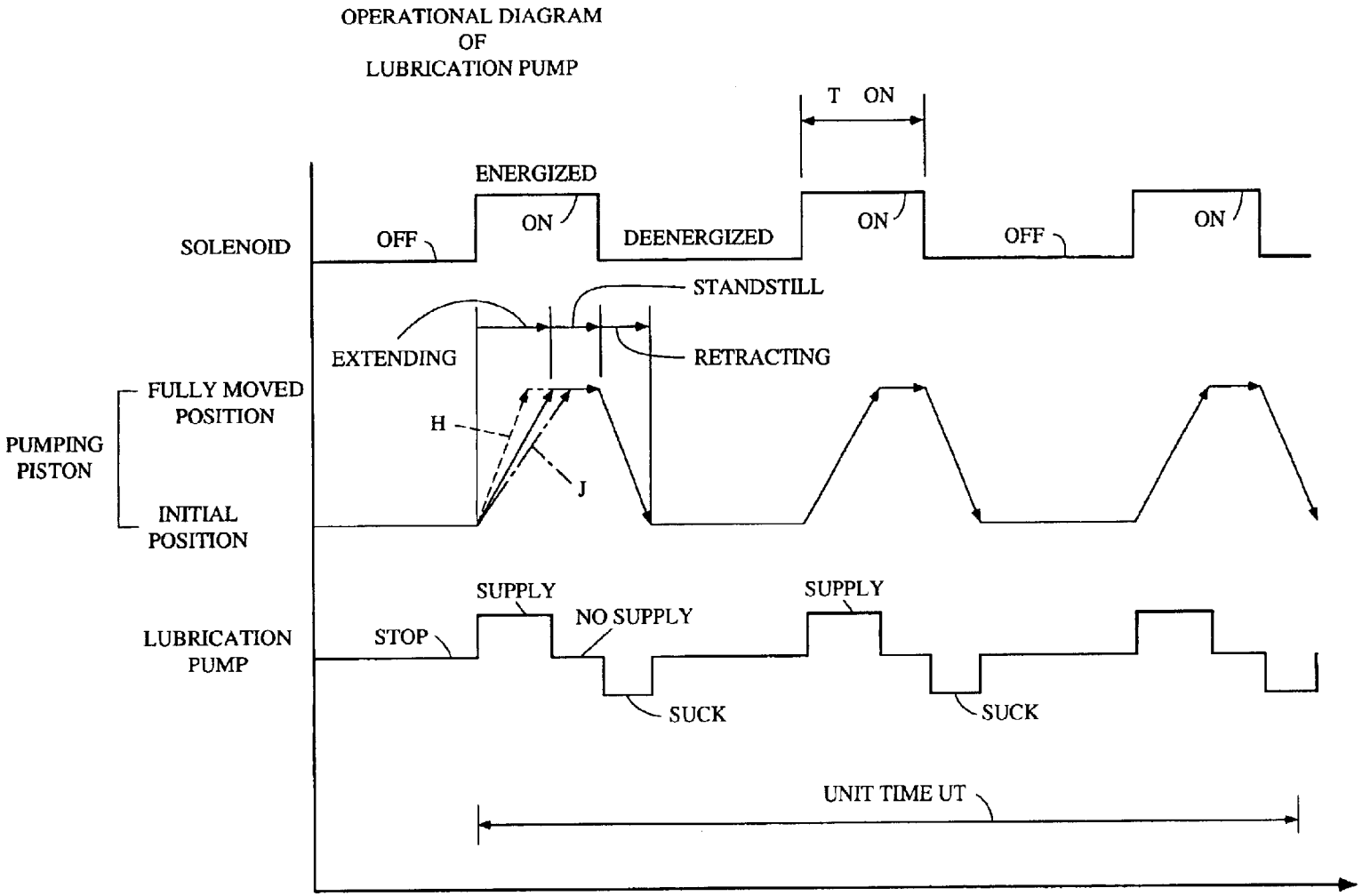
FIG. 3 illustrates a timing chart in accordance with which the lubrication pump of FIGS. 1 and 2 can operate.

With reference to FIGS. 2 and 3, the solenoid 108 is energized when an ON signal is provided from the ECU 76 and is de-energized when an OFF signal is provided or when the ON signal is not provided. An electric power supply device such as, for example, a battery, preferably is provided to supply electric power at least to the ECU 76 and the solenoid 108. The solenoid 108 actuates the plunger 160 while energized and releases the plunger 160 while de-energized.

Preferably, the ECU 76 provides the solenoid 108 with a sequential control command in which a high voltage part and a low voltage part alternately and repeatedly appear, which is also known as a "duty cycle". The high voltage part corresponds to the ON signal and the low voltage part corresponds to the OFF signal.

In the preferred embodiment, the lubrication pump 98 periodically pressurizes the lubricant 100 under control of the ECU 76. Preferably, the ECU 76 determines a frequency of periodic pressurization for the lubrication pump 98 and also determines a pressurization time of the lubrication pump 98, described in greater detail below.

With continued reference to FIGS. 2 and 3, in an initial state, the piston 134 stays at the initial position as indicated by the solid line of FIG. 2 and the lubricant 100 fills the remainder space in the cavity 130. The inlet and outlet ports 140, 142 are closed and the lubricant 100 is not sucked into the cavity 130 nor supplied to the intake passages 60 as indicated by the phrase "STOP" of FIG. 3.

The piston 134 moves toward the inlet and outlet ports 140, 142 from the initial position as indicated by the arrow A of FIG. 2 when the solenoid 108 is energized and the plunger 160 pushes the piston 134. The piston 134 in this state is indicated by the arrow of FIG. 3 having the phrase "EXTENDING." The piston 134 pressurizes the lubricant 100 in the cavity 130. The lubricant 100 in the cavity 130 thus moves out through each outlet port 142 toward the intake passage 60 because each check valve 156 opens. That is, the lubricant 100 is supplied to the intake passages 60 as indicated by the phrase "SUPPLY" of FIG. 3. The check valve 150 still closes at this moment.

The piston 134 comes to a standstill despite the solenoid 108 is still energized because the piston 134 has moved to the fully extended position in the stroke range FS indicated by the phantom line of FIG. 2. The phrase "STANDSTILL" of FIG. 3 indicates this state of the piston 134 when in the fully extended position. The lubricant 100 thus is no longer supplied to the intake passages 60 as indicated by the phrase "NO SUPPLY" of FIG. 3.

Then, the piston 134 returns back to the initial position under the force of the spring 138, as indicated by the arrow B of FIG. 2 when the solenoid 108 is de-energized to release the plunger 160. The phrase "RETRACTING" of FIG. 3 indicates the movement of the piston 134 under the force of the spring 138. The check valve 150 opens due to the reduced pressure caused by the retracting movement of the piston 134. The retracting movement of the piston 134 also draws lubricant 100 is into the cavity 130 through the lubricant supply passage 102, as indicated by the phrase "SUCK" of FIG. 3. Additionally, the reduced pressure in the chamber 130 causes the check valves 152 to close.

The solenoid 108 is remains de-energized for period of time, after the piston 134 has been retracted to the fully retracted position After this period of time, the solenoid 108 again is energized when the ON signal is provided by the ECU 76 as shown in FIG. 3. The ECU 76 causes the pump 98 to repeat these movements during operation of the engine 34.

As thus described, during an ON signal, the time corresponding to the state identified as "EXTENDING" (i.e., the time over which the piston 134 moves from the fully retracted position to the fully extended position is the foregoing pressurization time of the lubrication pump 98. In general, the pressurization time can vary. In other words, the piston 134 can reach the fully moved position faster under a certain condition, while the piston 134 can reach the fully moved position slower under a certain condition. The dotted arrow H of the state of the phrase "EXTENDING" of FIG. 3 indicates the faster movement. The one dot chain arrow J of the state of the phrase "EXTENDING" of FIG. 3 indicates the slower movement.

The speed of the piston 134 depends on, for example, the viscosity of the lubricant 100 or the internal pressure of the component to which the lubricant pump 98 injects the lubricant 100. The component can the intake passage 60 or the crankcase chamber in this embodiment. Thus, a higher viscosity of the lubricant 100 inhibits the piston 134 from moving faster. Similarly, a higher internal pressure inhibits the piston 134 from moving faster. If, however, the internal pressure is negative pressure, the pressure assists the piston 134 rather than inhibiting it. If the piston 134 reaches the fully extended position more quickly, the time corresponding to the "STANDSTILL" state can be longer. If the piston 134 reaches the fully moved position more slowly, the time corresponding to the state "STANDSTILL" can be shorter.

FIG. 3 also illustrates a range of unit time UT that varies depending on a frequency or cycle of the sequential control command that includes the ON signal and the OFF signal alternating with another. An amount Q of the lubricant 100 injected by the lubrication pump 98 per unit time UT is in proportion to the frequency of the sequential control command. The frequency can vary. The frequency preferably is determined by the ECU 76 such that the lubricant amount Q is generally optimum to lubricate engine portions at every moment.

The lubricant amount Q per unit time UT can be calculated by multiplying an amount of the lubricant 100 moved out from the cavity 130 for each stroke of the piston 134 by a frequency of the sequential control command (i.e., the number of times the piston 134 completes a "SUPPLY" movement within the time UT). That is, if the amount of the lubricant 100 moved out from the cavity 130 per one stroke of the piston 134 is given by the reference Qa and the frequency of the sequential control command is given by the reference F, the lubricant amount Q is calculated by the following equation:

$$Q=Qa\times F$$

Figure 4:
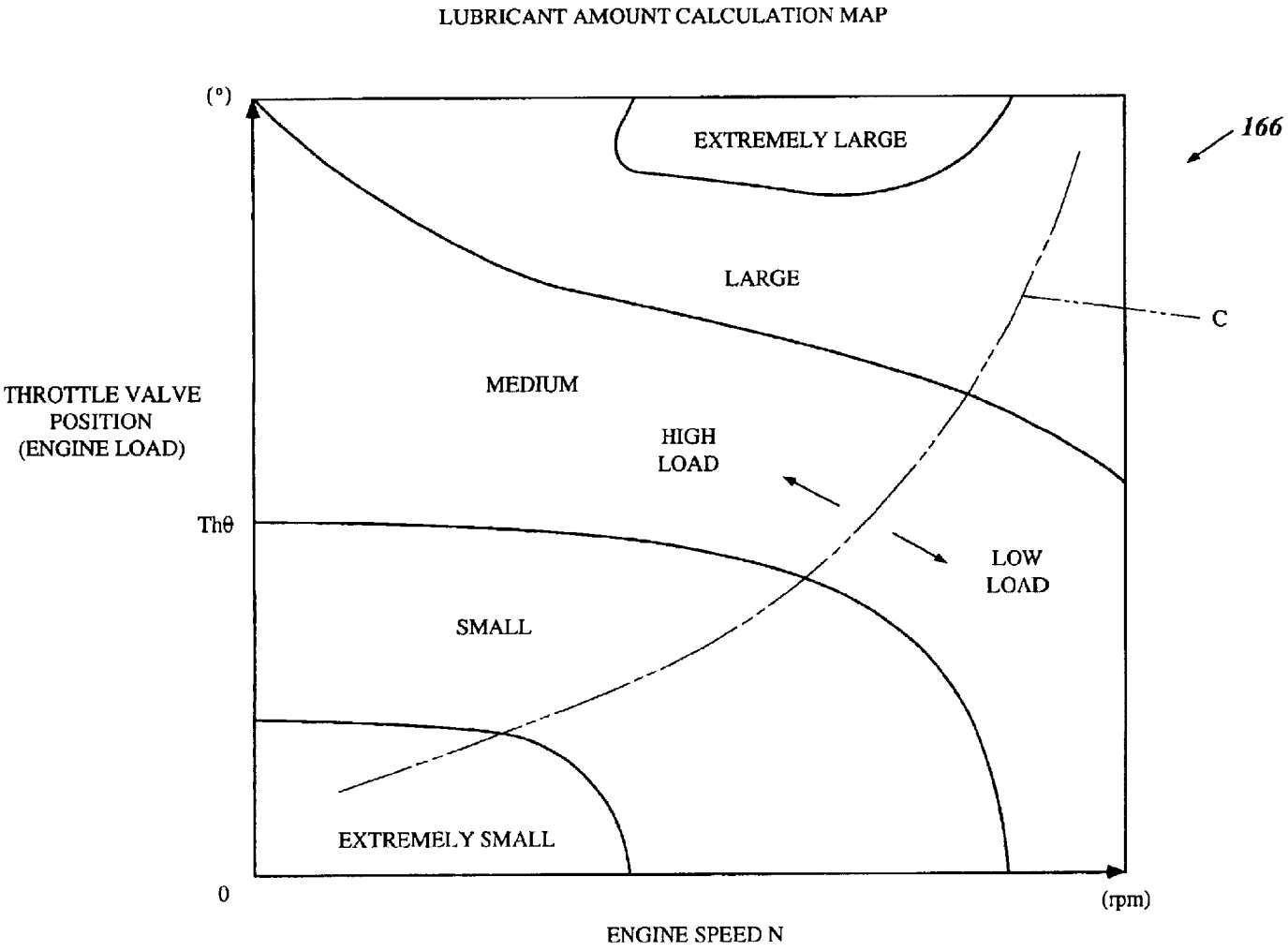
FIG. 4 illustrates a lubricant amount control map that provides an amount of lubricant corresponding to an engine speed and an engine load.

In this preferred embodiment, the ECU 76 can calculate a desired lubricant amount Q using a lubricant amount calculation map 166 shown in FIG. 4. That is, the lubricant amount Q can be determined based upon the engine speed N and the engine load. In this embodiment, the engine load is the throttle valve position Th?. As described above, the engine speed N is calculated by the ECU 76 using the crankshaft angle position sensed by the crankshaft angle position sensor 112. The engine load or throttle valve position Th? is provided by the throttle valve position sensor 114. The intake pressure or the air amount sensed by the intake pressure sensor or the air amount sensor, respectively, can be used instead of the throttle valve position to represent the engine load.

With reference to FIG. 4, the lubricant amount calculation map 166 provides various lubricant amounts Q ranging from extremely small, small, medium, large and extremely large amounts in accordance with the engine speed N and the engine load Th?. In general, the lubricant amount Q is extremely small when both the engine speed N and the engine load Th? are low. On the other hand, the lubricant amount Q is extremely large generally when both the engine speed N and the engine load Th? are high.

The phantom line C shows a typical change of the lubricant amount Q regarding the engine 34 of the outboard motor 30. The area under the line C generally represents a low load area relative to the engine speed N, while the area above the line C generally represents a high load area relative to the engine speed N.

The ECU 76 can also be configured to calculate a desired frequency F. For example, the ECU 76 can be configured to calculate the frequency F using an equation F=Q/Qa derived from the equation set forth above, Q=Qa×F. In a preferred embodiment, the ECU 76 uses a frequency control map (not shown) in which a specific frequency F is given if a particular lubricant amount Q is specified.

The lubricant amount Q in the lubricant amount calculation map 166 is an amount of the lubricant 100 that is desired under a normal temperature condition. For example, the normal temperature is approximately 17° C. During operation, the lubricant amount Q varies in accordance with the temperature $T_L$ of the lubricant 100 because the viscosity of the lubricant 100 changes in accordance with the temperature $T_L$ of the lubricant 100. For example, if the temperature $T_E$ of the engine 34 is low and accordingly the lubricant temperature $T_L$ also is low, it is desirable that the amount of the lubricant 100 is greater than the lubricant amount Q because the viscosity of the lubricant 100 is greater.

In general, the lower the lubricant temperature $T_L$, the higher the viscosity, although the viscosity does not vary linearly relative to the lubricant temperature $T_L$. If the viscosity is high, the lubricant 100 is difficult to pump and thus more difficult to move toward the engine 34 because the lubricant 100 can behave like a lump or mass that prevents smooth flow of the lubricant 100. Thus, the lubrication system 94 requires a larger amount of lubricant when the lubricant temperature $T_L$ is low rather than when the lubricant temperature $T_L$ is high. The ECU 76 thus adjusts the frequency F in accordance with the lubricant temperature $T_L$. Preferably, the ECU 76 calculates an adjusted frequency $F_A$ using an adjustment coefficient.

Figure 5:
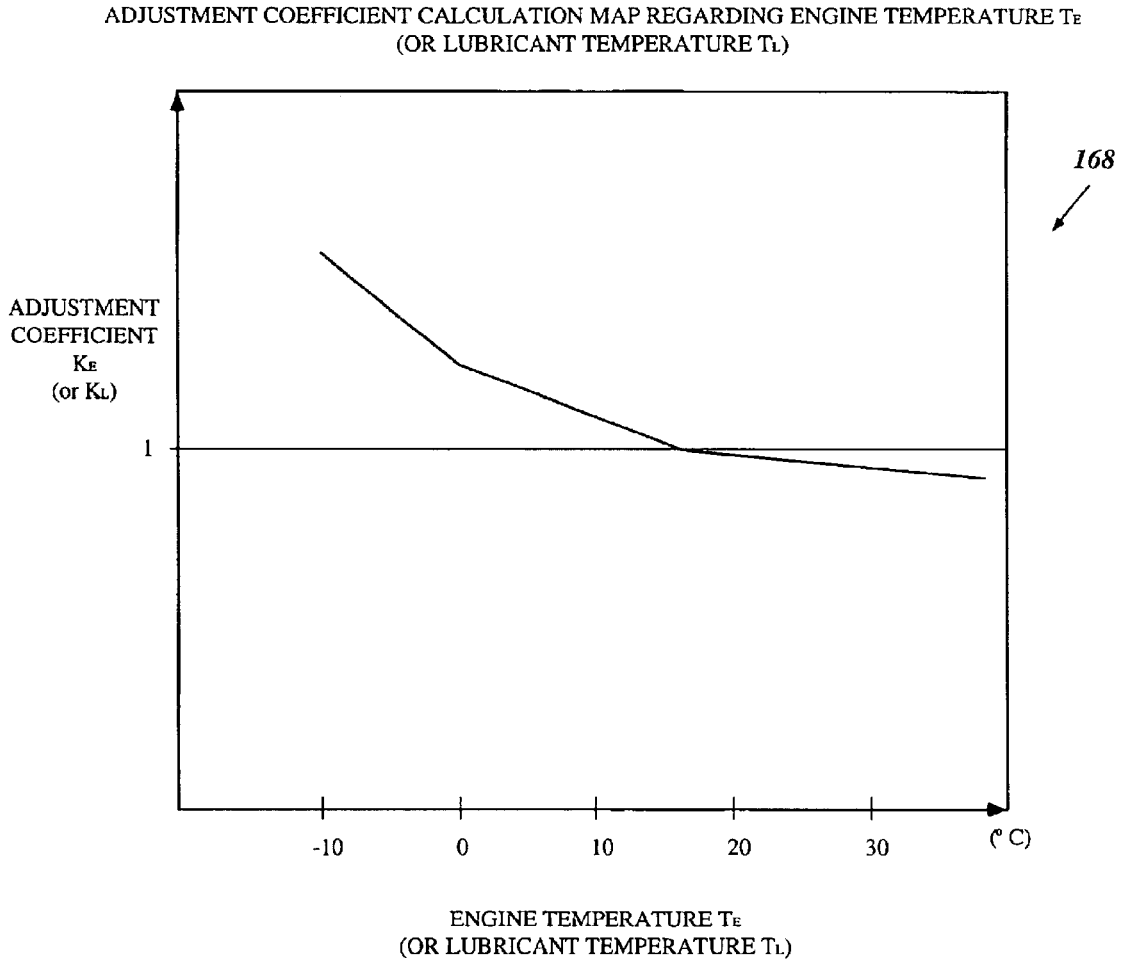
FIG. 5 illustrates a lubricant amount adjustment calculation map that provides an adjustment coefficient corresponding to an engine temperature or a lubricant temperature.

FIG. 5 illustrates an adjustment coefficient calculation map 168 that is used by the ECU 76 in this embodiment. The lubricant temperature $T_L$ varies generally in accordance with the engine temperature $T_E$. The ECU 76 thus can use an adjustment coefficient $K_E$ in connection with the engine temperature $T_E$ instead of an adjustment coefficient $K_L$ in connection with the lubricant temperature $T_L$.

The adjustment coefficient calculation map 168 provides a specific adjustment coefficient $K_E$ corresponding to a specific engine temperature $T_E$. Generally, the coefficient $K_E$ becomes smaller when the engine temperature $T_E$ becomes higher as shown in FIG. 5. The coefficient $K_E$ is "1" generally at the engine temperature $T_E$ is 17° C. The engine temperature $T_E$ is sensed by the engine temperature sensor 118. The ECU 76 calculates the adjusted frequency $F_A$ by multiplying the frequency F by the adjustment coefficient $K_E$. That is, the adjustment equation is indicated as follows:

$$F_A=F\times K_E$$

The ECU 76 can, of course, use an adjustment coefficient $K_L$ in connection with the lubricant temperature $T_L$. The adjustment coefficient calculation map 168 of FIG. 5 also shows the relationship between the adjustment coefficient $K_L$ and the lubricant temperature $T_L$ because the relationship therebetween is quite similar to the relationship between the adjustment coefficient $K_E$ and the engine temperature $T_E$. In this alternative, the adjustment coefficient calculation map 168 provides a specific adjustment coefficient $K_L$ corresponding to a specific lubricant temperature $T_L$. The lubricant temperature $T_L$ can be sensed by he lubricant temperature sensor 116. Also, the ECU 76 calculates the adjusted frequency $F_A$ by multiplying the frequency F by the adjustment coefficient $K_L$. That is, the adjustment equation is indicated as follows:

$$F_A=F\times K_L$$

In one variation, the ECU 76 can calculate an adjusted lubricant amount using the adjustment coefficient $K_E$ or $K_L$. That is, the adjusted lubricant amount can be obtained by multiplying the lubricant amount Q by the adjustment coefficient $K_E$ or $K_L$ as follows:

$$Q_A=Q\times K_E \text{ or } K_L \ (Q_A\text{: adjusted lubricant amount})$$

Then, the ECU 76 can calculate the adjusted frequency $F_A$ based upon the adjusted lubricant amount.

With the frequency $F_A$ desired frequency determined, the ECU 76 can be configured to further calculate the duration $T_{ON}$ of the ON signal to vary the duration $T_{ON}$ in accordance with the environmental conditions.

Preferably, the duration $T_{ON}$ of the ON signal is precisely equal to the pressurization time, which corresponds to the state "EXTENDING" of the pumping piston 34 (FIG. 3), and the time of "STANDSTILL" is eliminated, because the solenoid 108 merely wastes the electric power during the time of "STANDSTILL." As described above, the pressurization time varies in response to, for example, the viscosity of the lubricant 100 or the pressure inside of the intake passages 60 or the crankcase chamber. Accordingly, the ECU 76 further calculates the duration $T_{ON}$ of the ON signal. Thus, at least some of the "STANDSTILL" can be eliminated, thereby saving electric power and reducing the total energization time of the solenoid 108.

Figure 6:
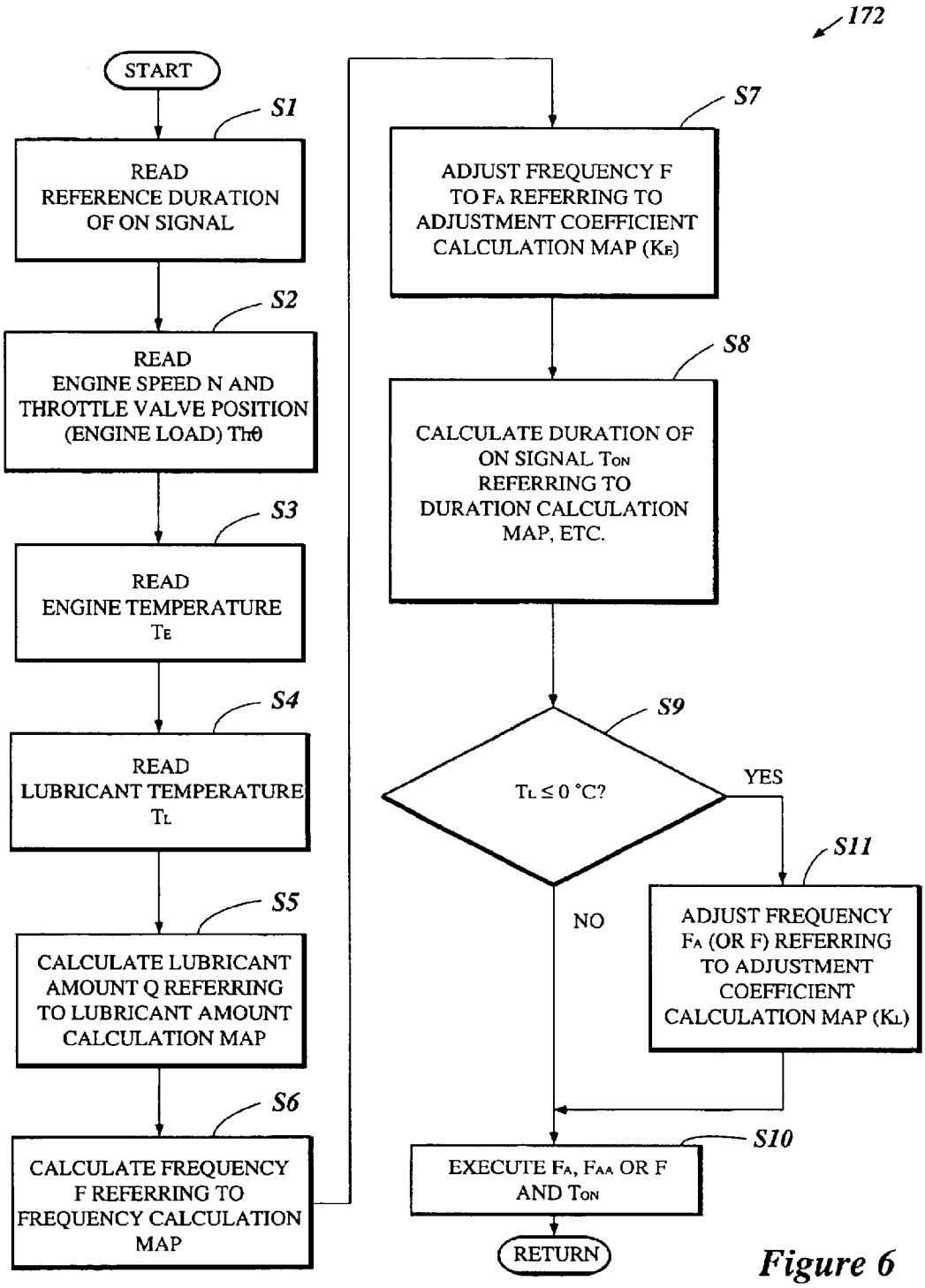
FIG. 6 illustrates a flow chart of a preferred control routine with which a control device of the lubrication system can controls the lubrication pump of FIGS. 1 and 2.

FIG. 6 illustrates a method that can be used to control the pump 98. In the illustrated embodiment, the method is represented by a flow chart, which is used to represent decisions and operations of a control routine 172. It is to be noted that the various portions of the method described below, including decisions and operations, can be performed in orders different from that described below. Generally, the control routine 172 can be used to operate the ECU 72 to determine the lubricant amount Q and the frequency F, to adjust the frequency F, to determines the duration $T_{ON}$ of the ON signal, and to command the lubrication pump 134 to operate in accordance with the determinations.

The routine 172 starts and proceeds to a step S1. In the step S1, the ECU 76 reads a reference duration of the ON signal at the step S1 and stores the duration of the ON signal in a proper storage area of the storage. For example, the reference ON duration can be a predetermined duration that will provide satisfactory operation of the pump 98 under all operating conditions. The reference duration corresponds to the solid line arrow identified as "ENERGIZED" and "Ton" in the solenoid control signal in FIG. 3. This reference duration can be constant. After the step S1, the routine 172 then proceeds to a step S2.

At the step S2, the engine speed and the engine load is determined. For example, the ECU 76 can calculate the engine speed N based upon the output of the crankshaft angle position sensor 112. Additionally, the ECU 76 can determine the engine load based on the throttle vale position Th? from the output of the throttle valve position sensor 114. The ECU 76 stores the engine speed N and the engine load Th? in a proper storage area of the storage device of the ECU 72. The routine 172 then proceeds to a step S3.

At the step S3, the engine temperature is determined. For example, the ECU 76 can read the engine temperature $T_E$ from the engine temperature sensor 118. Preferably, the ECU 76 stores the engine temperature $T_L$ in a proper storage area of the storage device. The routine 172 then proceeds to a step S4.

At the step S4, the lubricant temperature $T_L$ is determined. For example, the ECU 76 can read the lubricant temperature $T_L$ from the lubricant temperature sensor 116. Preferably, the ECU 76 and stores the lubricant temperature $T_L$ in a proper storage area of the storage device. The routine 172 then proceeds to a step S5.

At the step S5, a desired lubricant amount Q is determined. For example, The ECU 76, can calculate the desired lubricant amount Q using the lubricant amount calculation map 166 of FIG. 4 and based upon the engine speed N and the engine load Th? stored in the storage area of the storage device. Preferably, the ECU 76 stores the lubricant amount Q in a proper storage area of the storage device. The routine 172 then proceeds to a step S6.

At the step S6, a desired frequency F of operation of the pump 98 is determined. For example, the ECU 76 can calculate the frequency F using the frequency calculation map (not shown) and based upon the lubricant amount Q stored in the storage area of the storage. Additionally, ECU 76 preferably stores the frequency F in a proper storage area of the storage device. The routine 172 then proceeds to a step S7.

At the step S7, the adjustment coefficient $K_E$ or the adjustment coefficient $K_L$ is determined. For example, the ECU 76 can calculate the adjustment coefficient $K_E$ or the adjustment coefficient $K_L$ based upon the engine temperature $T_E$ or the lubricant temperature $T_L$, respectively, using the adjustment coefficient calculation map 168 of FIG. 5. In this embodiment, the ECU 76 calculates the adjustment coefficient $K_E$. Then, the ECU 76 calculates the adjusted frequency $F_A$ using the adjustment coefficient $K_E$ and replaces the stored frequency F by the adjusted frequency $F_A$. The routine 172 then proceeds to a step S8.

At the step S8, a reduced duration time $T_{ON}$ is determined. For example, the ECU 76 can calculate the adjusted duration $T_{ON}$ of the ON signal. In a preferred embodiment, the ECU 76 can calculate the adjusted duration $T_{ON}$ using a duration calculation map 176 of FIG. 7 or a duration calculation map 178 of FIG. 8. If the lubrication pump 98 delivers the lubricant 100 to the intake passages 60, the ECU 76 uses the duration calculation map 176 of FIG. 7. If the lubrication pump 98 delivers the lubricant 100 to the crankcase chamber, the ECU 76 uses the duration calculation map 178 of FIG. 8.

Both the duration calculation maps 176, 178 are based upon two parameters which are the engine speed and the engine load Th?. That is, the duration calculation maps 176, 178 provide various adjusted durations $T_{ON}$ ranging between extremely short, short, medium, long and extremely long in accordance with the engine speed N and the engine load Th?. In the maps 176, 178, the adjusted duration $T_{ON}$ generally increases with the engine speed N and/or the engine load Th?.

Figure 7:
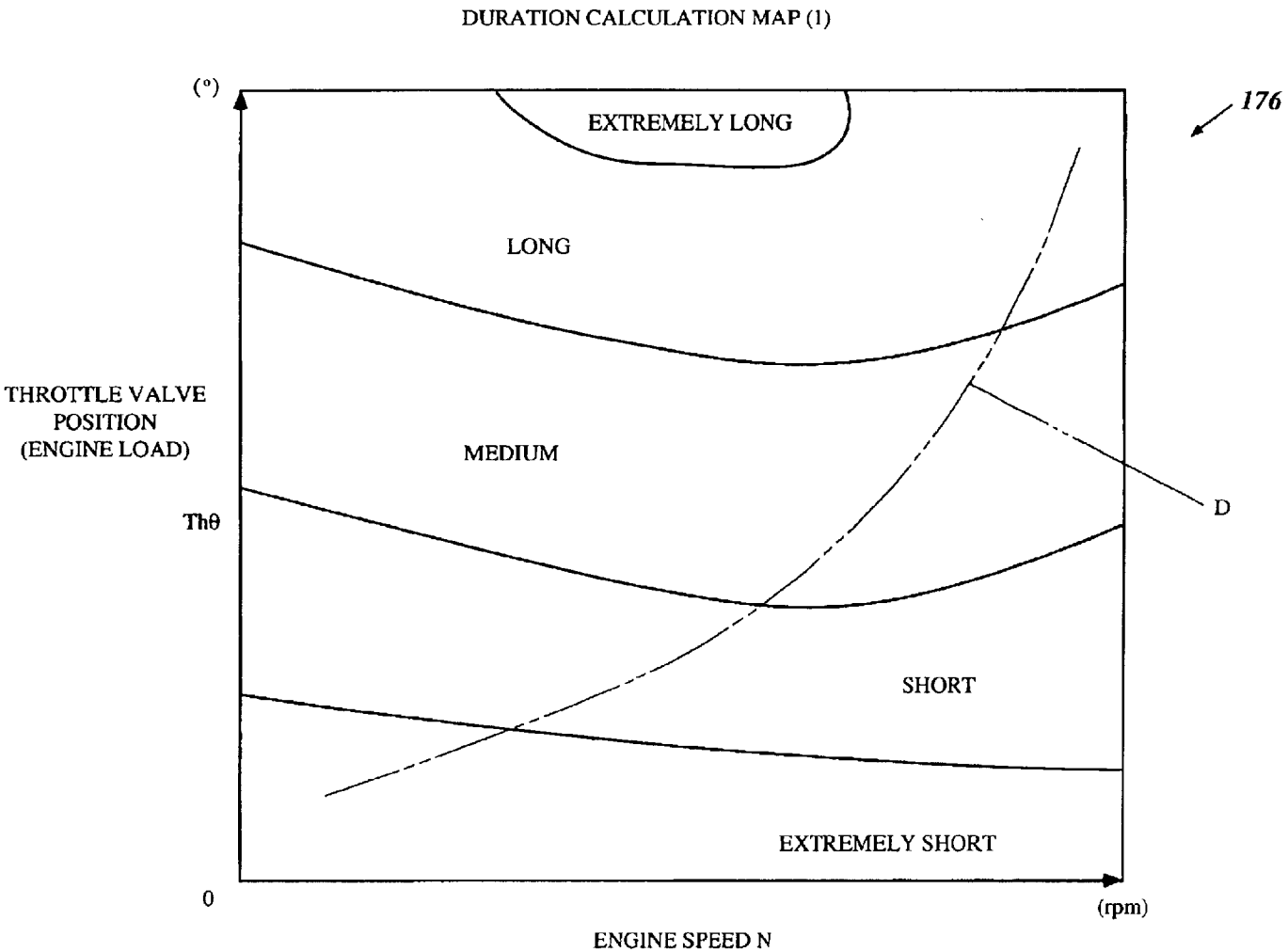
FIG. 7 illustrates a duration calculation map for the lubrication pump of FIGS. 1 and 2 that can provide a duration of ON signal of a solenoid actuator of the lubrication pump corresponding to an engine speed and an engine load, wherein the duration calculation map is used for a control of the lubrication pump delivering the lubricant into the air intake passage of FIG. 1.
Figure 8:
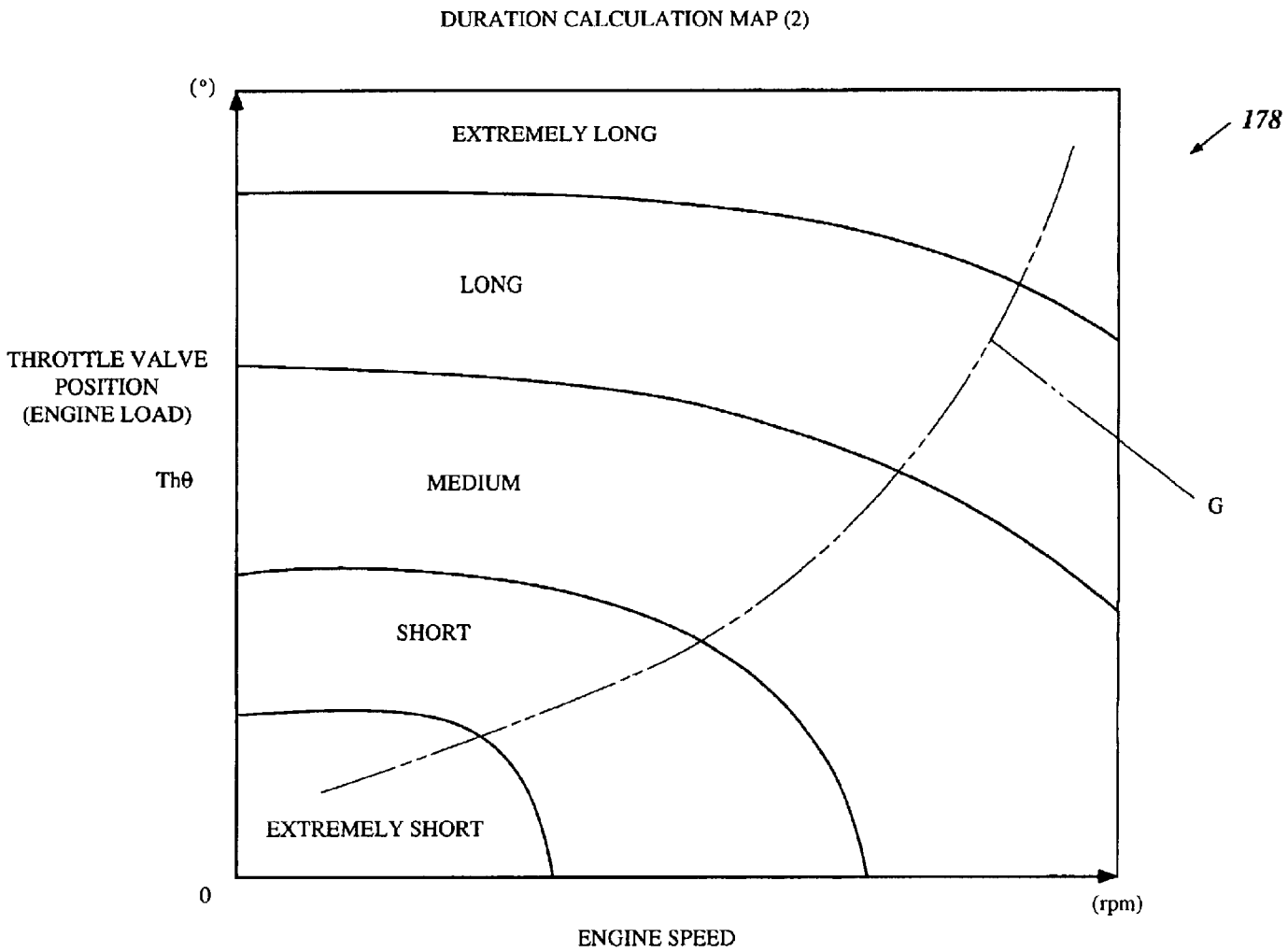
FIG. 8 illustrates another duration calculation map for the lubrication pump of FIGS. 1 and 2 that can provide a duration of ON signal of the solenoid actuator of the lubrication pump corresponding to an engine speed and an engine load, wherein the duration calculation map is used for a control of the lubrication pump delivering the lubricant into a crankcase chamber of the engine of FIG. 1.

The phantom line D of FIG. 7 and the phantom line G of FIG. 8 show a typical change of the adjusted duration $T_{ON}$ of each map 176, 178 during operation of the engine 34 of the outboard motor 30. The adjusted duration $T_{ON}$ of the ON signal preferably is given in the duration calculation maps 176, 178 such that the duration $T_{ON}$ is equal to or slightly longer than a time in which the piston 134 moves from the initial position to the fully moved position under any conditions of the engine speed N and the engine load Th? (i.e., a time for one stroke of the piston 134).

The initial reference duration $T_{ON}$ read in the step S1 can correspond to the largest area in the maps 176, 178. For example, the area of the medium period in each map 76, 78 can be suitable as the reference duration. If the adjusted duration $T_{ON}$ determined in step S8 is equal to the reference duration, the ECU 76 keeps the reference duration in the storage device. If the adjusted duration $T_{ON}$ is different from the reference duration, the ECU 76 replaces the reference duration with the adjusted duration $T_{ON}$. The routine 172 then proceeds to a step S9.

In one variation of the routine 172, the step S1 can be omitted such that the initial reference duration is not used. In this variation, the adjusted duration $T_{ON}$ from the duration calculation map 176, 178 is stored into the proper storage area of the storage at the step S8.

In another variation, the duration $T_{ON}$ can be calculated based upon either the engine speed N or the engine load Th? rather than based upon both of them. Also, in a further variation, the duration $T_{ON}$ can be calculated based upon either the engine temperature $T_E$ or the lubricant temperature $T_L$, or both of the engine temperature $T_E$ and the lubricant temperature $T_L$, because the viscosity of the lubricant 100 can affect the pressurization time (i.e., the time corresponding to the state "EXTENDING" of FIG. 3 and the time for one stroke of the piston 134) as described above. In general, the higher the viscosity of the lubricant 100, the longer the duration $T_{ON}$ can be used. Thus, the adjusted duration $T_{ON}$ can be determined based upon at least one of the engine speed N, the engine load Th?, the engine temperature $T_E$ or the lubricant temperature $T_L$.

In such performing such determinations, the ECU 76 can use any maps, equations and other measures for calculation other than the duration calculation map 176, 178. For example, the adjustment coefficient calculation map 168 of FIG. 5 (either in connection with the engine temperature $T_E$ or the lubricant temperature $T_L$) is applicable. The adjusted duration $T_{ON}$ can be calculated by multiplying the reference duration of the ON signal read at the step S1 by the adjustment coefficient $K_E$ or $K_L$.

As described above, the ECU 76 can adjust the frequency F based upon the engine temperature $T_E$ at the step S7 in this embodiment. Because the viscosity of the lubricant 100 at temperatures under approximately 0° C. can particularly affect the amount of the lubricant 100, the ECU 76 in this embodiment further adjusts the adjusted frequency $F_A$ referring to the lubricant temperature $T_L$. For instance, the further adjustment can used immediately after the engine 34 is started in a cold atmospheric temperature which is lower than 0° C.

Thus, at the step S9, it is determined whether the lubricant temperature $T_L$ is equal to or less than 0° C. For example, the ECU 76 can determine whether the lubricant temperature $T_L$ is equal to or less than 0° C. If the determination at the step S9 is negative, the ECU 76 recognizes that the further adjustment to the frequency is not necessary and the routine 172 proceeds to a step S10. The ECU 76 executes the adjusted frequency $F_A$ (or the frequency F if under the normal temperature condition) and the adjusted duration $T_{ON}$ to control the solenoid actuator 108. The routine 172 then returns back to the step S1 to repeat the routine of the routine 172.

If the determination at the step S9 is positive, the routine 172 proceeds to a step S11. At the step S11, the adjustment coefficient $K_L$ is determined. For example, the ECU 76 can calculate the adjustment coefficient $K_L$ based upon the lubricant temperature $T_L$ using the adjustment coefficient calculation map 168 of FIG. 5 that is related to the lubricant temperature $T_L$. Then, the ECU 76 calculates a further adjusted frequency $F_{AA}$ using the adjustment coefficient $K_L$ and replaces the stored frequency F or the stored adjusted frequency $F_A$ by the further adjusted frequency $F_{AA}$. Then, the routine 172 proceeds to the step S10 to execute the further adjusted frequency $F_{AA}$ and the adjusted duration $T_{ON}$ to control the solenoid actuator 108. The routine 172 returns back to the step S1 to repeat the routine of the routine 172.

In one variation, the ECU 76 calculates, at the step S7, the adjustment coefficient $K_L$ based upon the lubricant temperature $T_L$ using the adjustment coefficient calculation map 168 of FIG. 5 that is related to the lubricant temperature $T_L$. The steps S9 and S11 can be omitted in this variation.

It should be noted that the adjusted duration $T_{ON}$ executed at the step S10 is not a fixed value and varies as calculated at the step S8 in this embodiment.

Also, in this embodiment, the same amount of the lubricant 100 is delivered to the fuel delivery unit 82 from the additional outlet ports 142 of the lubrication pump 98 through the lubricant delivery passage 106. This lubricant 100 is mixed with the fuel 72 and will be injected into the combustion chambers with the fuel 72 by the fuel injectors 74. Alternatively, if the lubricant 100 to the fuel delivery unit 82 is pressurized by another pump, the amount of lubricant 100 to the fuel delivery unit 82 can be different from the lubricant amount injected into the intake passages 60.

In preferred embodiment described above, the duration $T_{ON}$ of the ON signal varies in accordance with at least one of the engine speed N, the engine load Th?, the engine temperature $T_E$ or the lubricant temperature $T_L$. This is advantageous because the time of "STANDSTILL" of FIG. 3 can be shortened as short as possible or be completely eliminated. Thus, the electric power will not be wasted to uselessly keep the solenoid actuator 108 in the activated state.

Generally, the duration $T_{ON}$ in the arrangement that the lubricant 100 is delivered to the intake passage 60 (shown in actual line of FIG. 1) can be shorter than the arrangement that the lubricant 100 is delivered to the crankcase chamber (shown in phantom line of FIG. 1) because the negative pressure in the intake passage 60 is greater than the negative pressure in the crankcase chamber. That is, the negative pressure can assist the injection of the lubricant 100 rather than inhibit the injection thereof. Accordingly, the duration $T_{ON}$ in the duration calculation map 176 is shorter than the duration $T_{ON}$ in the duration calculation map 178. For a similar reason, the duration $T_{ON}$ when the throttle valve open degree is small can be shorter than the duration $T_{ON}$ when the throttle valve open degree is large under the same engine speed condition because the negative pressure when the throttle valve open degree is small is larger than the negative pressure when the throttle valve open degree is large.

As thus described, the lubrication system 94 in the preferred embodiment can provide an appropriate amount of lubricant to the engine portions in every engine operation. Additionally, because of the appropriate amount of lubricant, white smoke can be reduced the discharged exhaust gases.

A similar lubrication system for a two-cycle engine is disclosed in, for example, a co-pending U.S. application filed May 15, 2003, titled LUBRICATION SYSTEM FOR TWO-CYCLE ENGINE, which serial number is 10/439,049, the entire contents of which is hereby expressly incorporated by reference.

Although this invention has been disclosed in the context of a certain preferred embodiment and examples, it will be understood by those skilled in the art that the present invention extends beyond the specifically disclosed embodiment to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combination or sub-combinations of the specific features and aspects of the embodiments or variations may be made and still fall within the scope of the invention. It should be understood that various features and aspects of the disclosed embodiment can be combined with or substituted for one another in order to form varying modes of the disclosed invention. Thus, it is intended that the scope of the present invention herein-disclosed should not be limited by the particular disclosed embodiments described above, but should be determined only by a fair reading of the claims that follow.

What is claimed is:

1. An internal combustion engine comprising a lubrication system arranged to lubricate at least a portion of the engine with lubricant, the lubrication system having a lubrication pump that pressurizes the lubricant toward the portion of the engine, a first sensor configured to sense an engine speed of the engine, a second sensor configured to sense an engine load of the engine, and a control device configured to control the lubrication pump, the control device determining an amount of lubricant that is pressurized by the lubrication pump based upon outputs from the first and second sensors to control the lubrication pump, such that the amount of lubricant is changed in accordance with changes in engine load sensed by the second sensor.

2. The engine as set forth in claim 1, wherein the lubrication pump includes a solenoid driving a piston, the solenoid configured to move the piston toward a first position so as to discharge lubricant from the lubrication pump.

3. The engine as set forth in claim 2, wherein the solenoid is configured to move the piston toward the first position when the solenoid receives an energization signal from the control device.

4. The engine as set forth in claim 3, wherein the control device is configured to reduce the duration of the energization signal so as to minimize the time over which the piston is held at the first position.

5. The engine as set forth in claim 3, wherein the control device is configured to determine an adjusted energization signal sufficiently long to cause the piston to move to the first position and shorter than a longest energization signal output from the control device.

6. The engine as set forth in claim 3, wherein the control device is configured to change a duration of the energization signal based on changes in engine speed.

7. The engine as set forth in claim 3, wherein the control device is configured to change a duration of the energization signal based on changes in engine load.

8. The engine as set forth in claim 7, wherein the control device is configured to change a duration of the energization signal based on changes in engine speed.

9. The engine as set forth in claim 3, wherein the control device is configured to change a duration of the energization signal based on changes in at least one of engine speed, engine load, engine temperature, and lubricant temperature.

10. The engine as set forth in claim 1 additionally comprising an air intake system arranged to supply air to a combustion chamber of the engine, the intake system having a throttle valve that regulates an amount of the air, the second sensor sensing a position of the throttle valve.

11. The engine as set forth in claim 1, wherein the control device is configured to minimize the electrical energy used for powering the lubrication pump by reducing a dwell time of the lubrication pump, based on changes in at least one of engine load and engine speed.

12. An internal combustion engine comprising a lubrication system arranged to lubricate at least a portion of the engine with lubricant, the lubrication system having a lubrication pump that periodically pressurizes the lubricant toward the portion of the engine, a first sensor configured to sense an engine speed of the engine, a second sensor configured to sense an engine load of the engine, and a control device configured to control the lubrication pump, the control device determining a frequency of periodic pressurization by the lubrication pump based upon outputs from the first and second sensors to control the lubrication pump, such that the frequency of periodic pressurization is changed in accordance with changes in engine load.

13. The engine as set forth in claim 12, wherein the control device is configured to transmit an energization signal to the lubrication pump, wherein the duration of the energization signal is based upon at least one of outputs from the first and second sensors.

14. The engine as set forth in claim 12 additionally comprising a third sensor configured to sense a temperature of the lubricant or the engine, the control device adjusting the frequency based upon an output from the third sensor.

15. The engine as set forth in claim 12, wherein the control device is configured to reduce the electrical energy used for powering the lubrication pump by reducing a dwell time of the lubrication pump, based on changes in at least one of engine load and engine speed.

16. A control method for a lubrication system that lubricates at least a portion of an engine, the method comprising sensing an engine speed of the engine, sensing an engine load of the engine, determining an amount of lubricant that is pressurized by a lubrication pump based upon the sensed engine speed and the sensed engine load such that the amount of lubricant is changed in accordance with changes in engine load, and actuating the lubrication pump to pressurize the determined amount of lubricant.

17. The control method as set forth in claim 16 additionally comprising sensing a position of a throttle valve that regulates an amount of air to a combustion chamber of the engine to sense the engine load.

18. The control method as set forth in claim 16, wherein the lubrication pump periodically pressurizes the lubricant, the method additionally comprising determining a frequency of periodic pressurization by the lubrication pump based upon at least the sensed engine speed or the sensed engine load.

19. The control method as set forth in claim 18 additionally comprising sensing a temperature of the lubricant or the engine, and adjusting the frequency based upon the sensed temperature of the lubricant or the engine.

20. The control method as set forth in claim 16 additionally comprising determining a duration of an energization signal for the lubrication pump based upon at least the sensed engine speed or the sensed engine load.

21. The control method as set forth in claim 20 additionally comprising detecting changes in engine speed, detecting changes in engine load, and changing the duration of the energization signal when at least one of the engine speed and the engine load changes.

22. The control method as set forth in claim 16 additionally comprising minimizing the electrical energy used for powering the lubrication pump by reducing a dwell time of the lubrication pump, based on changes in at least one of engine load and engine speed.

23. A control method for a lubrication system that lubricates at least a portion of an engine, the lubrication system having a lubrication pump periodically pressurizes lubricant, the method comprising sensing an engine speed of the engine, sensing an engine load of the engine, determining a frequency of periodic pressurization by the lubrication pump based upon the sensed engine speed and the sensed engine load, changing the frequency of periodic pressurization in accordance with changes in engine load, and actuating the lubrication pump to pressurize the lubricant with the determined frequency.

24. The control method as set forth in claim 23 additionally comprising determining a pressurization time of the lubrication pump based upon at least the sensed engine speed or the sensed engine load.

25. The control method as set forth in claim 23 additionally comprising sensing a temperature of the lubricant or the engine, and adjusting the frequency based upon the sensed temperature of the lubricant or the engine.

26. The control method as set forth in claim 23 additionally comprising reducing the electrical energy used for powering the lubrication pump by reducing a dwell time of the lubrication pump, based on changes in at least one of engine load and engine speed.

27. An internal combustion engine comprising a lubrication system arranged to lubricate at least a portion of the engine with lubricant, the lubrication system having a lubrication pump that pressurizes the lubricant toward the portion of the engine, a first sensor configured to sense an engine speed of the engine, a second sensor configured to sense an engine load of the engine, a control device configured to control the lubrication pump, and means for minimizing the electrical energy used for powering the lubrication pump by reducing a dwell time of the lubrication pump, based on changes in at least one of engine load and engine speed.

28. An engine as set forth in claim 27, wherein the lubrication pump includes a solenoid, wherein the dwell time corresponds to a time over which the solenoid remains energized without moving.

* * * * *

UNITED STATES PATENT AND TRADEMARK OFFICE

CERTIFICATE OF CORRECTION

PATENT NO. : 6,904,879 B2
APPLICATION NO. : 10/626216
DATED : June 14, 2005
INVENTOR(S) : Masahiko Kato It is certified that error appears in the above-identified patent and that said Letters Patent is hereby corrected as shown below:

On The Title Page Item 56, line 2, after "filed" please insert -- on --.

On The Title Page Item 56, line 3, please delete "2003," and insert -- 2003. --, therefor.

On The Title Page Item 56, line 3, after "Inventor" please insert -- : --.

At column 11, line 1, after "FIG. 2" please insert -- , --.

At column 11, line 13, after "position" please insert -- . --.

At column 11, line 21, after "position" please insert -- ) --.

At column 14, line 27, please delete "$T_L$" and insert -- $T_E$ --, therefor.

Signed and Sealed this

Sixth Day of May, 2008

JON W. DUDAS
*Director of the United States Patent and Trademark Office*